United States Patent [19]

Brignole

[11] Patent Number: 4,778,182

[45] Date of Patent: Oct. 18, 1988

[54] LUCKY NUMBER SELECTOR

[76] Inventor: Guillermo F. Brignole, 1190 Medford Rd., Pasadena, Calif. 91107

[21] Appl. No.: 72,894

[22] Filed: Jul. 14, 1987

[51] Int. Cl.[4] ..... A63F 9/00

[52] U.S. Cl. ..... 273/144 A

[58] Field of Search ..... 273/144 R, 144 A, 144 B

[56] References Cited

U.S. PATENT DOCUMENTS

| | | | |
|---|---|---|---|
| 1,475,730 | 11/1923 | Walter | 222/360 |
| 2,633,273 | 3/1953 | Benjamin et al. | 222/363 |
| 3,810,535 | 5/1974 | Phipps | 194/85 |
| 4,280,702 | 7/1981 | Tremblay | 273/144 |
| 4,732,387 | 3/1988 | Elinski | 273/144 A |

FOREIGN PATENT DOCUMENTS

| | | | |
|---|---|---|---|
| 2539314 | 7/1984 | France | 273/144 B |
| 3205380 | 8/1983 | Fed. Rep. of Germany | 273/144 B |
| 0654681 | 2/1986 | Switzerland | 273/144 B |

*Primary Examiner*—Carlton R. Croyle
*Assistant Examiner*—Eugene L. Szczecina, Jr.
*Attorney, Agent, or Firm*—Edward J. DaRin

[57] ABSTRACT

A device for selecting data such as numbers to be used by a player of games of chance wherein a hollow spherical storage container is utilized to store objects or balls therein for discharge therefrom. The stored objects may be spherical balls having symbols and/or numbers marked thereon. The spherical container has a simple, manually controlled mechanism for discharging the stored objects or balls therefrom and operable in a reverse direction to restore the discharged objects or balls for subsequent re-use in again playing the game of chance.

9 Claims, 2 Drawing Sheets

LUCKY NUMBER SELECTOR

FIELD OF INVENTION

This invention relates to a device for randomly selecting data, i.e., "lucky" numbers, to be used in games of chance such as lotteries, bingo, keno, etc., and, more particularly, to a device for discharging objects bearing the gaming data, one at a time, and permitting the discharged objects to be restored in the device for reuse thereof.

BACKGROUND OF INVENTION

Various types of games played on the basis of the random selection of numbers are well-known in the art. Some of these games are bingo, keno, etc. In recent years government entities have entered the field with lotteries which depend on the selection of several numbers to win various monetary prizes and the like. A lottery player must select the numbers he wishes to bet and after paying for playing the game, the player hopes that the selected series of numbers will be selected as a winner or to proceed to the next stage of the game or winning a prize. It is difficult to determine which numbers should be selected as a possible winning number. It would therefore appear that there is a present need for a simple, inexpensive device to be used for selecting the data or numbers to be used in such games of chance.

California is one of the states that have recently introduced a lottery. Machines have been devised for selecting numbers to be used in the lottery. These machines are relatively expensive, and the players have substantially reduced their dependence on such machines in selecting the "lucky" numbers to be used in the lotteries. U.S. Pat. No. 4,280,702 discloses a device for selecting numbers for games of chance, such as the lotteries. This device comprises of a storage container for numbered balls that permits the balls to fall into a transparent tube for identifying the numbers on the balls as a means of selecting the numbers to be used for playing a lottery. The discharged balls may be restored in the container by moving the tube storing the balls from a dispensing position into a discharge orientation within the container so that they may fall back into the storage container.

Devices for dispensing articles such as pills, one at a time, are also known in the art. In U.S. Pat. No. 2,633,273 a dispensing cap for pill containers is disclosed. The pills are dispensed through an opening in the top plate of the cap into a cavity in a lower plate. The cavity, with the pill inside, is then rotated to a position where it lines up with an outside aperture from which the pill is dispensed. The cavity is rotated back to the original position to retrieve another pill to be dispensed, and the process is repeated.

Other well-known devices have been utilized for dispensing objects, one at a time, such as gum ball machines. Two such gum ball machines are found in the U.S. Pat. Nos. 1,475,730 and 3,810,535. The devices disclosed in the aforementioned gum ball machine patents each utilize a circular plate with a plurality of circular openings to transfer held objects from an opening in an exterior plate to an interior opening. In these gum ball machines, however, the devices move in only one direction whereby the discharged gum balls are not restored within the machine for obvious reasons.

SUMMARY OF INVENTION

The present invention provides an improved device for discharging objects having preselected symbols thereon for use in selecting the desired symbols to be used in playing games such as lotteries or the like wherein the objects are discharged, one at a time, from the device and may be restored in the device for subsequent use in selecting another group of lucky symbols. The device may be in the form of a hollow container for storing the objects marked with preselected symbols and/or numbers, along with a simple and inexpensive control mechanism for controlling the discharge of the objects, one at a time, from the container and restoring them into the container. The device may be constructed and defined of a plastic material so as to be sold at an inexpensive price or given away with the purchase of other items or with lottery tickets. The device is simple in nature so that it can be readily used by anyone without requiring any special skills or experiences.

From a broad structural standpoint, the present invention comprises a device for discharging objects, one at a time, from a storage container and restoring the discharged objects back into the storage container. The device comprises a hollow container having an object storing volume for loosely storing a plurality of objects to be discharged from the hollow container and to be restored in the storage volume once discharged. The hollow container is provided with an aperture sized to permit the stored object to be discharged through the aperture from the container and to be restored into said storing volume through the same aperture. The hollow container includes control means enclosed within the container adjacent the object storing volume and said discharge aperture for isolating the objects stored in the volume from the discharge aperture. The control means is constructed and defined to receive a single stored object and to manually move the object, from outside the container, in a preselected direction to position the object in alignment with the discharge outlet to permit the object to be discharged from the container through the discharge outlet therefor. The control means is further characterized as permitting the objects to be discharged one at a time. The control means is movable in a direction reverse from the preselected discharge direction to cause a discharged object to be restored within the storing volume by inserting the discharged object into the discharge aperture and to move it out of alignment with the discharge aperture and thereby it is restored within the object storing volume.

From a specific standpoint, the present invention comprises a device for selecting data to be used in games of chance. The device comprises a hollow, spherical container having an object storing volume therein and an operable control means arranged within the container and accessible outside of the container for controlling the discharge of the stored objects and restorage of the discharged objects. The container has an aperture sized to permit the objects to be moved therethrough and an arcuate slot defined in the wall of the container in a preselected spaced relationship with the container aperture. The operable control means has an operating member extending through the arcuate slot for the container so as to be manually accessible from outside of the container. The control means includes a control member pivotably secured to the container and pivotable by means of the operating member from end to end of the container arcuate slot. The control means has an aperture sized to receive and hold one of the objects to be stored within the hollow container and to be entrapped against the adjacent spherical wall to permit the held object to be moved to the container aperture to be discharged therefrom or to receive an object positioned within the container aperture and movable from a position of entrappment until the control means is moved to a position to allow the object to be stored in the storing volume of the container.

BRIEF DESCRIPTION OF THE DRAWINGS

These and other features of the present invention may be more fully appreciated when considered in the light of the following specification and drawings, in which.

DETAILED DESCRIPTION OF THE PREFERRED EMBODIMENT OF THE INVENTION

Figure 3:
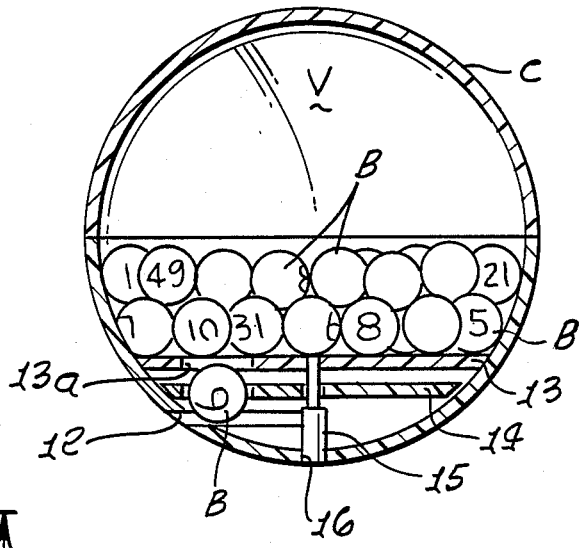
FIG. 3 is a cross-sectional view taken along the line 3—3 of FIG. 1.
Figure 4:
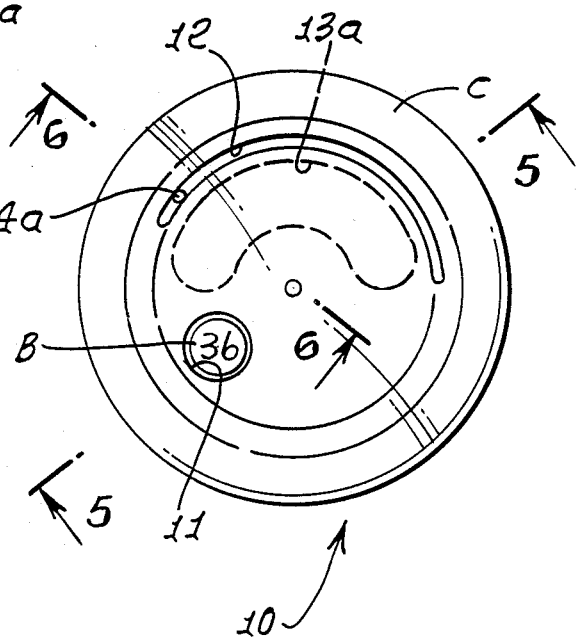
FIG. 4 is a bottom end view similar to FIG. 2, but illustrating a ball in the discharge aperture for the device and the operating member in a position after it has been moved in a counter-clockwise rotation from that shown in FIG. 2 to place a stored object within the discharge aperture for the device.

Now referring to the drawings, the presently preferred embodiment of the device 10 for discharging the objects having the gaming data marked thereon will be described in detail. The device 10 comprises a hollow container C having an object storing volume V for loosely storing a plurality of objects B to be discharged from the hollow container and to be restored in the storage volume V, once discharged therefrom. The hollow container C has an aperture 11 sized to permit a stored object to be discharged through said aperture from within the container C and to be restored into the storing volume V through said aperture 11. It should be recognized that the hollow container C may take any form or shape but is illustrated in the form of a hollow sphere with the objects B stored therein being in the form of balls having numerical data marked thereon. The objects B stored within the device 10 for the purposes of the invention may be of any form, and other data other than numerical data may be marked thereon, such as symbols or combination of symbols and numerical data, depending on the game of chance desired to be played. For the purposes of facilitating the description and understanding of the present invention, the hollow sphere is illustrated as it may be constructed from a transparent plastic material. The storage volume V for storing the balls B is of such a size to permit the balls to be agitated or mixed up for selecting the desired "lucky" numbers from the device 10 by shaking the container C. As illustrated in the drawings, the storage volume V consists of the hollow interior of one of the hemispheres forming the hollow container C, along with the portion of the other hemisphere forming the hollow container. In one particular application, 49 balls having a diameter of approximately $\frac{3}{8}$ inch may be stored within the hollow container C. The balls are marked with a numeral selected from 1–49. The balls B are stored within the volume V and are isolated from the discharge aperture 11 so as to be discharged, one at a time, under the control of the control mechanism for the device 10. When the container C is arranged in a discharge position, as illustrated in FIGS. 3 and 4, for example, the discharge aperture 11 would be located at the bottom of the device 10 to allow a ball B to be discharged therefrom.

Figure 1:
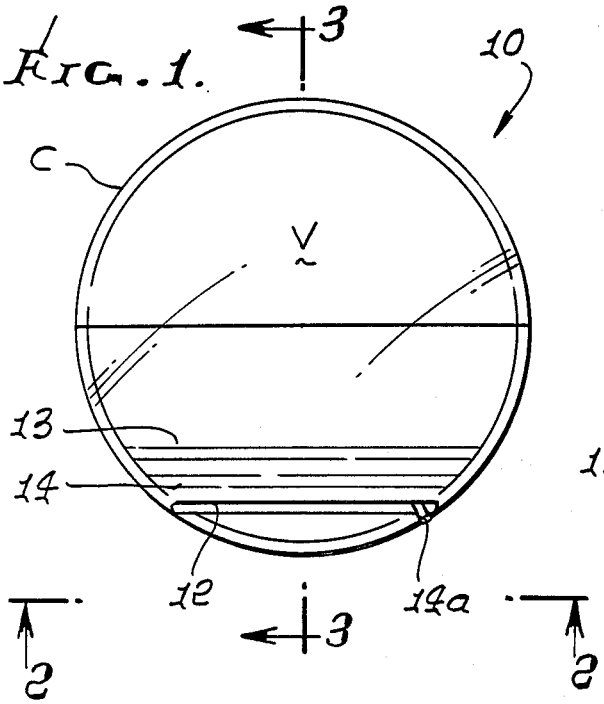
FIG. 1 is a front elevational view of the device for selecting data to be used in games of chance embodying the present invention.
Figure 2:
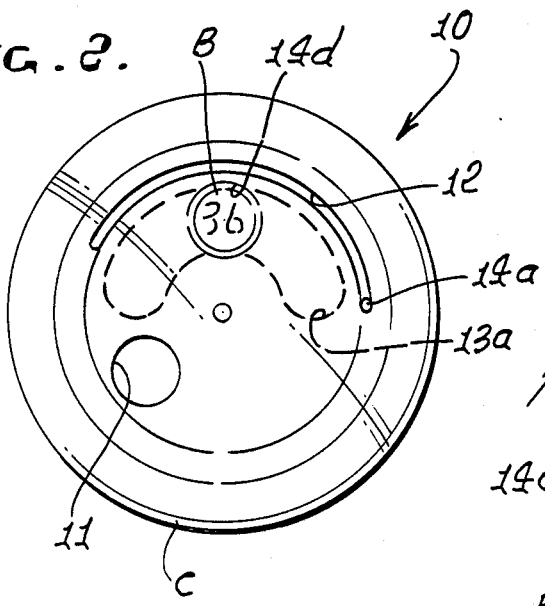
FIG. 2 is a bottom end view of the device of FIG. 1, illustrating the mechanism for discharging the objects and restoring the objects in dotted outline.
Figure 8:
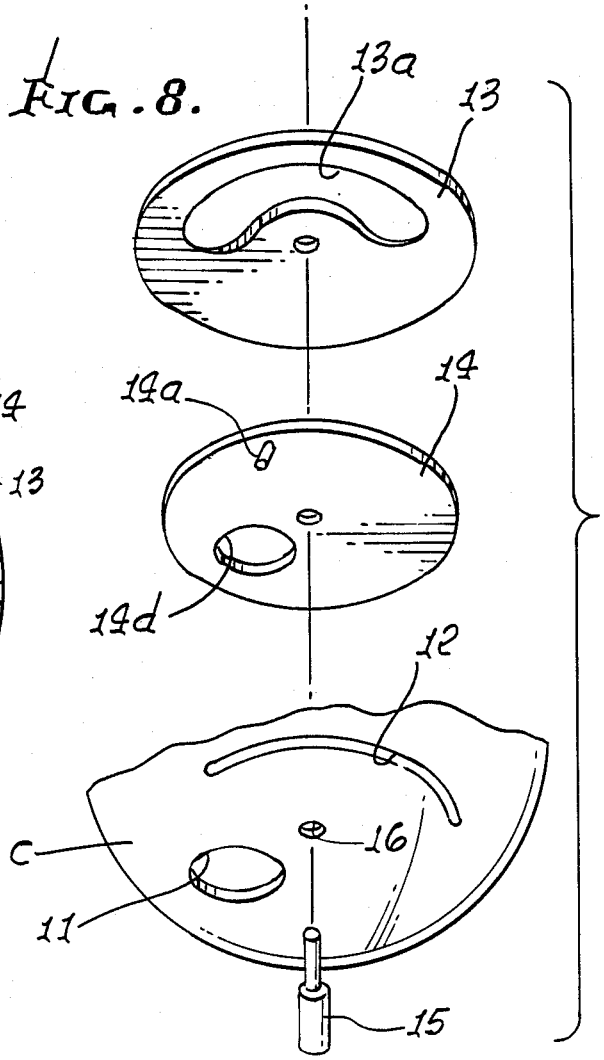
FIG. 8 is a partial, exploded view of the control mechanism and the adjacent portion of the storage container.

The control mechanism, in accordance with the present invention, is constructed and defined to receive a single stored object B and move the object or the ball in a preselected direction to position the object or ball B in alignment with the discharge outlet 11 to permit the object B to be discharged from the container C therethrough. This mechanism further allows the discharged ball B to be inserted into the discharge aperture 11 and by the movement of the control mechanism in the reverse direction from the discharge motion, cause the discharged object to be restored within the volume V for subsequent use of the stored object or ball B. Specifically, the control mechanism, as illustrated in the drawings and with particular reference to FIG. 8, illustrates that the discharge opening 11 is sized to permit a stored ball B to readily fall therethrough when it is arranged at the bottom hemisphere of the hollow container C. The bottom hemisphere of the container C is also provided with an arcuate slot 12 arranged adjacent the discharge aperture 11 in a spaced relationship therewith. A fixed or stationary plate 13 is secured within the bottom hemisphere for isolating the balls B from the discharge aperture 11. The plate 13 may be readily constructed of a plastic material with an arcuate slot **13*a* defined therein which has a length proportioned to the length of the container slot 12 for permitting the movement of the balls in response to the operation of the control mechanism. The plate 13 may be wedged between the interior side walls of the container C, as illustrated. The control mechanism includes a circular plate 14 arranged immediately below the fixed plate 13 in the bottom hemispherical portion of the container C and spaced from the side walls, as best illustrated in FIG. 3, for example. The plates 13 and 14 are secured in position to the bottom wall of the lower hemisphere of the container 10 by means of a pin 15. The pin 15 is tightly secured into an aperture 16 arranged between the aperture 11 and the slot 12; see FIG. 8. The pin 15 has a stepped bore so as to secure the plate 13 in a suitable sized aperture adjacent its end having a reduced diameter, along with the plate 14 which is also provided with a suitable aperture for receiving the reduced diameter portion of the pin 15. The aperture 16 for the hollow container is sized to snugly secure the pin 15 at its larger diameter. This relationship causes the plate 13 to be arranged in a fixed relationship between the walls of the container 10 and the plate 14 to be rotatably movable therein. The movable circular plate 14 includes an operating arm 14*a* secured thereto in a dependent relationship adjacent the periphery thereof so as to extend through the arcuate slot 12 and a discharge opening 14***d*, as best illustrated in FIG. 8. In the assembled relationship, the movable plate 14, when it is in a storage position in preparation for discharging one of the balls, would normally be arranged so that the operating arm 14*a* would extend from the right-hand extremity of the container slot 12, as best illustrated in FIG. 1. The grasping of the operating arm 14*a* by a user will allow the plate 14 to be rotated in a counter-clockwise direction, as illustrated in the drawings, to the opposite extremity of the slot 12, as in FIG. 4, and be returned back to its starting position (per FIG. 2) for accepting another ball B to be discharged therefrom.

Figure 5:
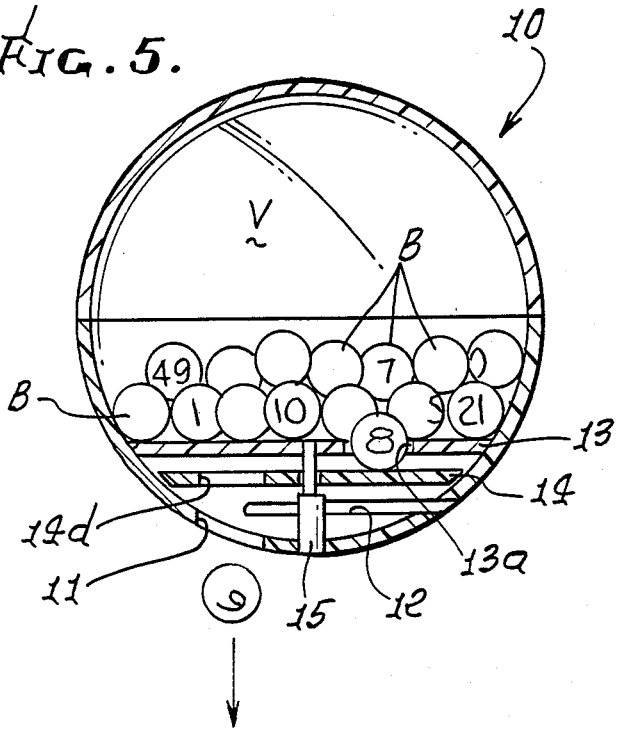
FIG. 5 is a cross-sectional view taken along the line 5—5 of FIG. 4.
Figure 6:
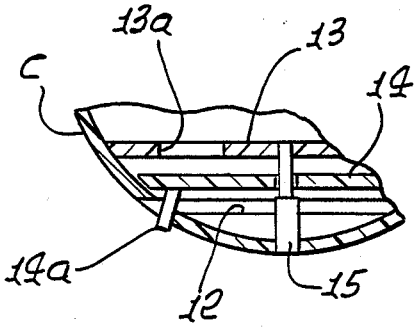
FIG. 6 is a partial, cross-sectional view taken along the line 6—6 of FIG. 4.

With the above structure in mind, the operation of the device 10 will now be explained. It will be assumed that a plurality of balls B have been stored in the volume V so that the device 10 is ready for use by an operator for selecting the numbers for use in the lottery or the like. In this relationship it will be assumed that the control arm 14*a* is at the right-hand extremity of the slot 12, as in FIGS. 1 and 2, and the balls B to be discharged will be arranged on the top surface of the fixed plate 13, as illustrated in FIGS. 3 and 5. The slot 13*a* for the fixed plate 13 permits the balls B to drop onto the movable plate 14. However, the movable plate, through the provision of the single discharge slot 14*d*, will only accept one of the balls B when the slot 13*a* and the discharge aperture 14*d* are in alignment to receive a ball. The ball B is entrapped between the bottom wall of the container C and the aperture 14*d*. By the operation of the operating arm 14*a*, the plate 14 can be rotated counter-clockwise so that the selected ball B can be moved or carried by the movement of the plate 14 to a position wherein the selected ball will be placed in alignment with the discharge aperture 11 and allow the ball to freely fall from the container 10. One such ball, bearing the numeral 8, is illustrated in FIG. 5 in the slot 13*a* and a ball B bearing the number 6 as it was discharged from the aperture 11. With the placement of the operating arm back into the right-hand extremity, another ball B can be selected and the operation will be repeated as described.

Figure 7:
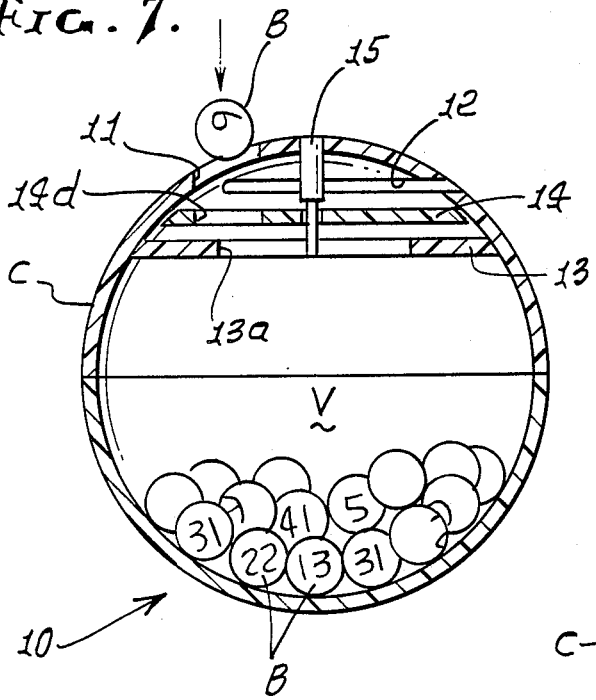
FIG. 7 is a cross-sectional view, similar to FIG. 5, but reversed in orientation in that the discharge opening is arranged at the top of the device for permitting a discharged object to be restored within the device.

To restore the discharged objects or balls B into the container C, the container is reversed in orientation from that illustrated in FIG. 5 for discharging the balls so that the discharge aperture 11 is arranged at the top of the container C, as in FIG. 7. This permits a discharged ball, such as the ball bearing numeral 6, to be positioned within the discharge aperture 11 and to be entrapped therein between the wall and the aperture 14*d* for the movable plate 14. The discharge aperture 14*d* for the plate 14 can then be moved through the operation of the arm 14*a* in the clockwise position to allow the discharged ball B (6) to be moved within the container C to allow the aperture 14*d* and the slot 13*a* to be aligned and, once this alignment is accomplished, the ball B will fall from the aperture 14*d* through the slot 13*a*, into the volume V, along with the remaining balls B, which are illustrated in FIG. 7 in the bottom portion of the container C. To reinsert further balls into the container C, the operation is reversed again to receive the next discharged ball B in the aperture 11 and move the operating arm 14*a* until the ball also drops into the volume V for restorage.

It should now be evident that the present invention has provided an improved, simple device that may be inexpensively constructed of inexpensive plastic materials for selecting data such as numbers to be used in games of chance, such as lotteries or the like, and the objects or balls discharged therefrom may be readily restored within the device for re-use of the objects or balls for subsequent selection of "lucky" data or numbers.

We claim:

1. A device for selecting data to be used in games of chance, said device comprising a hollow spherical container defined by a spherical wall of a preselected thickness and having an object storing volume therein and an operable control means arranged within the container and accessible from outside of the container for controlling the discharge of the stored objects and restorage of the discharged objects, said container having an aperture in the spherical wall sized to permit said objects to be moved therethrough and an arcuate slot defined in the spherical wall of the container in a preselected spaced relationship with said container aperture, said operable control means having an operating member extending through the arcuate slot for the container to be manually accessible from outside of the container, said control means including a control member pivotally secured to the container and pivotable by means of the operating member from end to end of the container arcuate slot, said control means having an aperture sized to receive and hold one of the objects to be stored within the hollow container and entrapped against the adjacent spherical wall to permit the held object to be moved to the container aperture to be discharged therefrom or to receive an object positioned within the container aperture and movable from a position of entrappment between the spherical wall and the aperture for the control means until the control means aperture is moved from an entrapped position to allow the object to be stored to move into the storing volume of the container.

2. A device for selecting data to be used in games of chance as defined in claim 1 wherein the objects to be stored and discharged from the spherical container are each marked with a preselected symbol thereon.

3. A device for selecting data to be used in games of chance as defined in claim 1 wherein the objects are marked so as to include different numerical data thereon.

4. A device for selecting data to be used in games of chance as defined in claims 2 or 3 wherein the objects are spherical in shape.

5. A device for selecting data to be used in games of chance as defined in claim 1 wherein said control means includes plate means arranged within the spherical container on the inside of the movable control means in a fixed relationship, said plate means having a slot to permit an object stored within said container to move therethrough and onto the aperture for the control means to be discharged from the container and to move from the aperture for the control means through the plate means slot for storage in the container.

6. A device for selecting data to be used in games of chance as defined in claim 5 wherein said hollow container includes a plurality of marked balls stored in the container on the opposite side of said plate means.

7. A device for selecting data to be used in games of chance as defined in claim 6 wherein the balls are loosely stored in the container and movable to assume random positions for discharge, the balls having numerals thereon and upon discharge the numerals are utilized in playing games of chance, such as lotteries or the like by a player.

8. A device for selecting data to be used in games of chance as defined in claim 1 wherein the spherical container is constructed of a light-weight plastic material.

9. A device for selecting data to be used in games of chance as defined in claim 5 or 8 wherein said control means is constructed of a preselected plastic material.

* * * * *